United States Patent [19]

Lier et al.

[11] Patent Number: 4,783,665

[45] Date of Patent: Nov. 8, 1988

[54] HYBRID MODE HORN ANTENNAS

[76] Inventors: Erik Lier, Myrtunet 28B, N-7078 Saupstad, Norge; Tor Schaug-Pettersen, Dalen Hageby 1, N-7000 Trondheim, Norge, both of Norway

[21] Appl. No.: 931,445

[22] PCT Filed: Feb. 28, 1986

[86] PCT No.: PCT/NO86/00022

§ 371 Date: Nov. 12, 1986

§ 102(e) Date: Nov. 12, 1986

[87] PCT Pub. No.: WO86/05327

PCT Pub. Date: Sep. 12, 1986

[30] Foreign Application Priority Data

Feb. 28, 1985 [NO] Norway ..... 850808

[51] Int. Cl.[4] ..... H01Q 13/00

[52] U.S. Cl. ..... 343/786; 343/785

[58] Field of Search ..... 343/785, 786, 783

[56] References Cited

U.S. PATENT DOCUMENTS

| | | | |
|---|---|---|---|
| 2,415,352 | 2/1947 | Iams | 250/11 |
| 3,414,903 | 12/1968 | Bartlett et al. | 343/753 |
| 3,430,244 | 2/1969 | Bartlett et al. | 343/755 |
| 3,588,754 | 6/1971 | Hafner | 343/785 |
| 3,611,391 | 10/1971 | Bartlett | 343/755 |
| 3,798,653 | 3/1974 | Jones, Jr. | 343/785 |
| 4,231,042 | 10/1980 | Turrin | 343/786 |
| 4,246,584 | 1/1981 | Noerpel | 343/786 |
| 4,419,671 | 12/1983 | Noerpel | 343/786 |
| 4,468,672 | 8/1984 | Dragone | 343/783 |
| 4,482,899 | 11/1984 | Dragone | 343/786 |

FOREIGN PATENT DOCUMENTS

| | | | |
|---|---|---|---|
| 1157146 | 11/1983 | Canada | 343/786 |
| 900709 | 11/1953 | Fed. Rep. of Germany . | |

OTHER PUBLICATIONS

Lawrie and Peters, Jr.; *IEEE Transactions on Antennas and Propagation*, Sep. 1966, vol. AP-14, pp. 605-610, "Modifications of Horn Antennas for Low Sidelobe Levels".

Clarricoats and Saha, *Electronics Letters*, May 1, 1969, vol. 5, pp. 187-189, "Theoretical Analysis of Cylindrical Hybrid Modes in a Corrugated Horn".

Clarricoats, *Electronics Letters*, May 1, 1969, vol. 5, pp. 189-190, "Analysis of Spherical Hybrid Modes in a Corrugated Conical Horn".

Potter, *The Microwave Journal*, Jun. 1963, vol. 11, pp. 71-78, "A New Horn Antenna with Suppressed Sidelobes and Equal Beamwidths".

Minnet et al., *IEEE Transactions on Antennas and Propagation*, vol. AP-14, Sep. 1966, pp. 654-666, "A Method of Synthesizing Radiation Patterns with Axial Symmetry".

Clarricoats and Salema, *Proc. IEEE*, Jul. 1973, vol. 120, pp. 741-749, "Antennas Employing Conical Dielectric Horns: Part 1-Propagation and Radiation Characteristics of Dielectric Cones".

Clarricoats & Salema, *Proc. IEEE. Jul. 1973, vol. 210, pp. 750-756, "Antennas Employing Conical Dielectric Horns: Part 2-The Cassegrain Antennas.*

*Primary Examiner*—William L. Sikes
*Assistant Examiner*—Hoanganh Le
*Attorney, Agent, or Firm*—Barnes & Thornburg

[57] ABSTRACT

A horn antenna with a cylindrical and an expanded (horn-shaped) waveguide for radiating or receiving polarized electromagnetic waves. The waveguide wall is partially or wholly covered with one or more grids (12) of electrical conducting material with dielectric layers between them. One possible design consists of a tapering (e.g., conical) core (10) of compact dielectric, which allows for the possibility of shaping the terminal surface (13) to a lens which curves the course of radiation in the aperture to the desired radiation graph. Another possible design where the horn wall consists of dielectric covered with metal grids has an especially light construction. The wall surfaces are developed with anisotrope and reactive impedance so that it mainly functions in the same way as a corrugated horn and thus gives low cross-polarizations across a large frequency area. This could be constructed with little weight and could easily be mass-produced. This will be easier to produce than corrugated horn, especially in the millimeter-wave area.

10 Claims, 3 Drawing Sheets

HYBRID MODE HORN ANTENNAS

BACKGROUND AND SUMMARY OF THE INVENTION

The invention concerns a horn antenna of the type presented in the introduction to claim 1, for radiating or receiving polarized electromagnetic waves.

These horn antennas are especially used when there is a need for low cross-polarization and possible low side lobes across a large frequency area, for example, as a feeding element in reflector antennas or as individual antenna element in the micro or millimeter-wave areas.

Corrugated horn antennas, which are commonly used for the above purposes, are referred to in the following works: R. E. Lawrie et al. "Modifications of Horn Antennas for Low Sidelobe Levels," *IEEE Trans.Antennas Propagat.*, vol. AP-14, September 1966, pp. 605–610; H. C. Minnett et al. "A Method of Synthesizing Radiation Patterns with Axial Symmetry", *IEEE Trans.Antennas Propagat.*, vol. AP-14, September 1966, pp. 645–646. These horn antennas are, however, difficult to produce commercially, especially in the millimeter-wave area.

Other corrugated horn antennas are described in the following works. P. J. B. Clarricoats et al, "Theoretical Analysis of Cylindrical Hybrid Modes in a Corrugated Horn", *Elektron. Lett.*, vol. 5, May 1, 1969, pp. 187–189; and P. J. B. Clarricoats, "Analysis of Spherical Hybrid Modes in a Corrugated Conical Horn," *Elektron. Lett.*, vol 5, May 1, 1969, pp 189–190. In these corrugated horn antennas the horn wall is made anisotrope and reactive, and it complies with the balanced hybrid condition of the hybrid $HE_{11}$ mode within the desired frequency band. Thus, the diagram of radiation in the E and H plans will become almost alike and give low cross-polarization.

Even though this type of antenna has in principle, satisfactory characteristics, it is burdened with disadvantages in regards to production.

The main object is, therefore, to create a horn antenna that has good electrical properties and is easy to manufacture. According to the invention, this can be achieved by developing the antenna in accordance with the characterizing part of claim 1.

Additional characteristics of the invention are given in the sub-claims.

It shall be pointed out that dielectric horn antennas are wellknown from, for example, P. J. B. Clarricoats and C. E. R. C. Salema, "Antennas Employing Conical Dielectric Horns," *Proc.Inst.Elec.Eng.*, vol.120, July 1973, pp. 741–756; and U.S. Pat. Nos. 3,414,903, 3,430,244 and 3,611,391. These consist of a plastic conical waveguide with a low refractive index, excited at the apex from a little horn antenna. Even if such hybrid mode antennas have low cross-polarization, a problem is created when the junction between the excitation horn and the plastic cone emits unwanted radiation. Moreover, the radiation poperties are quickly reduced if rain or pollution falls on the plastic wall. This means that these antennas must be covered with a radome, which adds to the costs of the construction.

Another familiar horn antenna with low cross polarization is the bimode horn, described by P. O. Potter, "A New Horn Antenna with Improved Sidelobes and Equal Beams," *Microwave J.*, vol. 11, June 1963, pp. 71–78. This has, true enough, a simple design, but with a narrow band width compared with the antennas described above.

The invention offers an advantageous alternative to wellknown hybrid and bimode horn antennas, and will, in many instances, be preferable.

The invention will be described in more detail below:

DETAILED DESCRIPTION OF THE DRAWINGS

Figure 1:
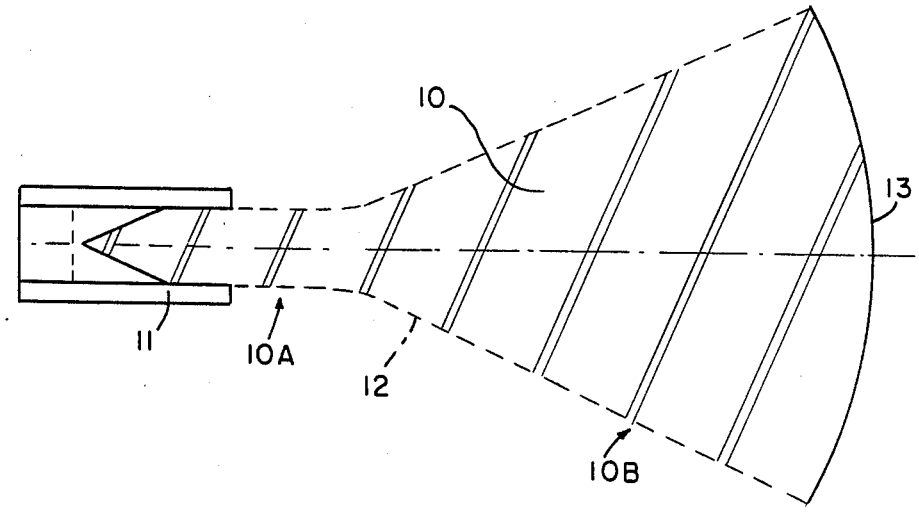
FIG. 1 illustrates an axial cross section through a horn antenna developed in accordance with the invention.

The antenna in FIG. 1 encompasses the dielectric cone 10 that, at the narrow end, has a cylindrical section 10A, and at the end of this has a conical-shaped tapering section 10B. The end of the cylindrical continuation of the dielectric cone 10 is surrounded by a tubular waveguide 11 that serves to excite the antenna.

The open section of the dielectric cone 10 is covered with a metal grid 12 on its surface. It has an evenly curved aperture 13.

Figure 2:
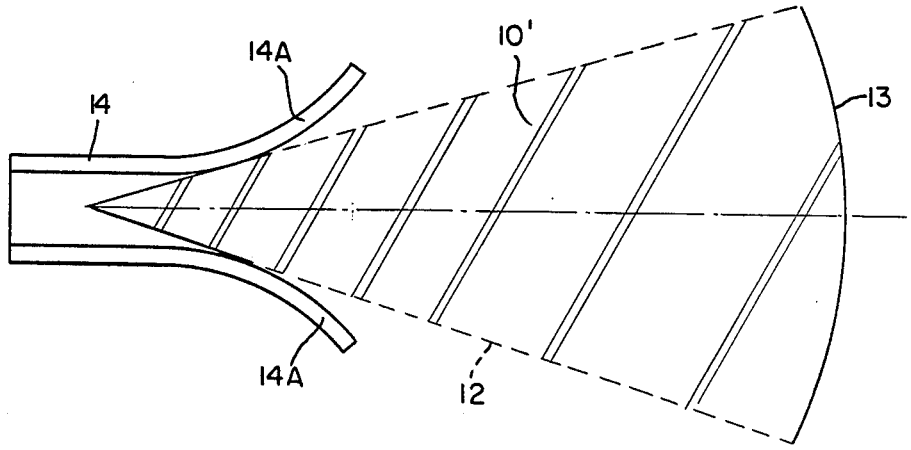
FIG. 2–4 illustrate corresponding axial cross sections through alternative embodiments of the invention.

FIG. 2 illustrates an alternative embodiment, where the dielectric element 10' is conical, and where a waveguide 14 has a horn-formed, projection end 14A. The waveguide or feeding horn 14 can have smooth or corrugated horn walls.

Figure 3:
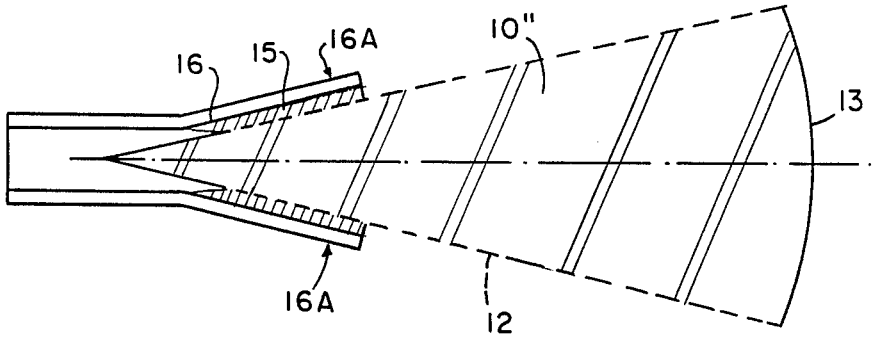

FIG. 3 illustrates a conical-shaped dielectric element 10'' that is surrounded at its narrow end by a waveguide 16 with a conically-widened end 16A. This waveguide or horn 16 has a smooth inner surface and is covered with a dielectric 15 in its conical section.

Figure 4:
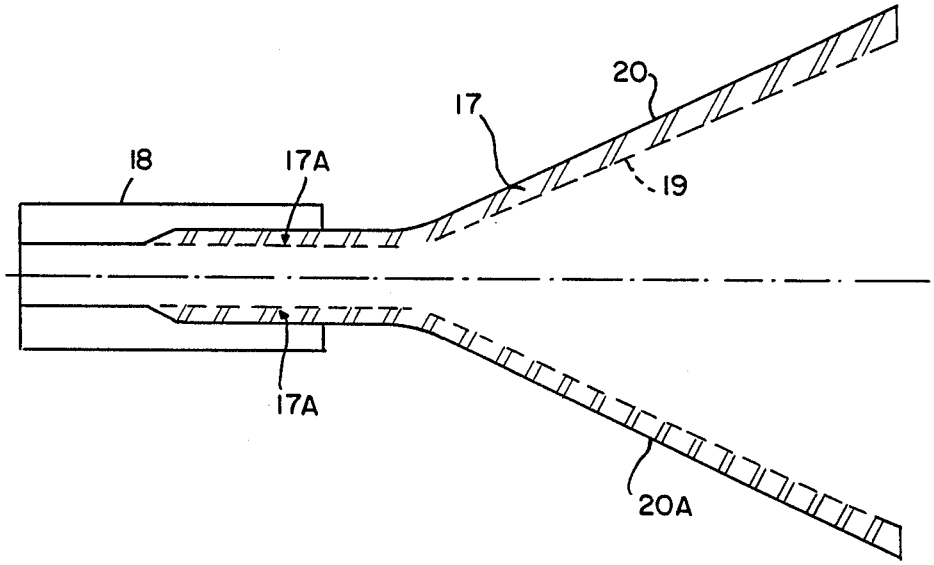

FIG. 4 illustrates an alternative embodiment that departs from the examples above in that it is without a central dielectric element. Instead, a dielectric horn wall 17 exists which is prepared with a metal grid 19 on its inner surface and with a continuous metal coating 20 and 20A on its outer surface. This conical horn wall 17 also has a cylindrical, tubular section 17A at the narrow end, this section being surrounded by a tubular waveguide 18 on its outer section.

The elements in FIGS. 1–4 have a circular cross-section, but this can vary in different ways, for example, with elliptical cross-sections for special purposes.

FIGS. 5 *a–e* shows examples of grid structures illustrated in the form of widened sectors of the horn wall. The grid structures can vary along the horn's surface (r-direction).

Figure 5A:
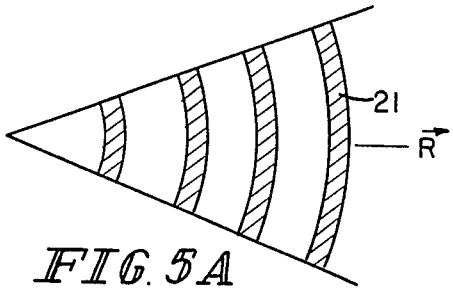
FIG. 5 illustrates examples of grid structures.

FIG. 5*a* shows metal rings 21 at even distances round the wall.

Figure 5D:
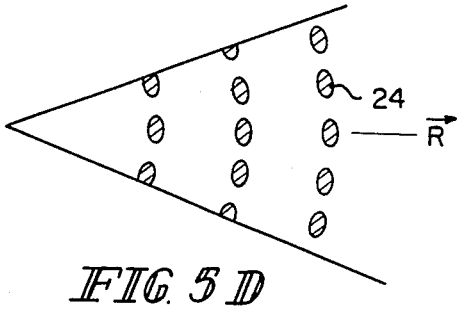
Figure 5B:
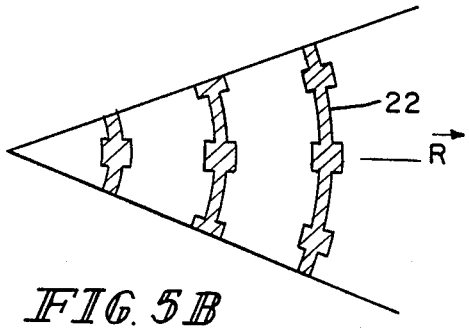

FIGS. 5*b* and *c* shows metal rings 22 and 23, respectively, with their respective thicknesses and curvatures to increase inductiveness.

FIG. 5*d* shows rows of metal spots 24 that in the example are elliptical, but they can be of arbitrary shape.

Figure 5E:
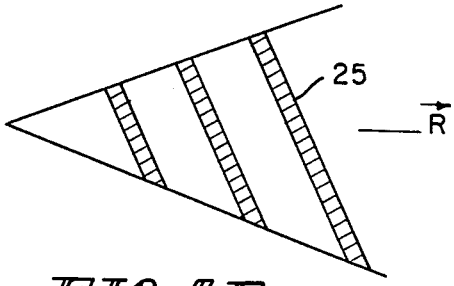
Figure 5C:
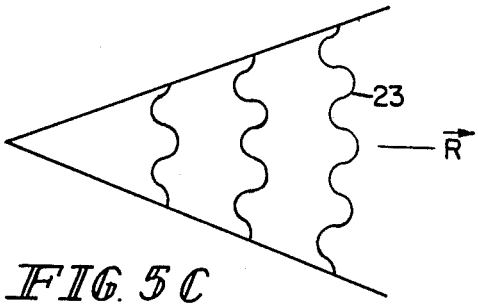

FIG. 5*e* shows a metal coil 25 with equal spacing over the entire length.

Figure 6:
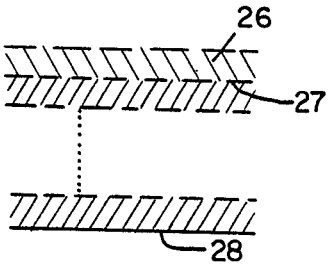
FIG. 6 illustrates how the horn wall can be made up of several layers.

Finally, FIG. 6 shows a cross-section through the horn wall with several (N) dielectric layers 26, where, in one or more of the interfaces between colliding layers, a metal girder 27 is located. The outer dielectric layer can be prepared with a continuous metal coating 28.

As the examples illustrate, the antenna is, in accordance with the invention, of simple construction. Experiments have shown that it also gives low cross-polarization and low side lobes across a large frequency band. Thus, it has favourable characteristics in regards to manufacture and use. The metal grids 12 and 19 are designed to give anisotrope and reactive wall impedance that comply with the balanced hybrid conditions, and provide that the horn can transmit the hybrid mode $HE_{11}$, for circular cross-sections and correspondingly desired modes for non-circular cross sections with the lowest possible cross-polarization across the largest possible frequency band.

The horn designs in FIGS. 1–3 can be completed with a lens surface that can be shaped to allow a desired radiation graph within the limits that are determined by the opening's size. The lens surfaces should have an adjustment layer, for example, a quarter-wave transformer layer with a refractive index between the refractive index of air and the refractive index of the dielectric. The reason for this is to hinder the field from being reflected on the lens surface and to contribute to cross-polarization and increased permanent wave conditions. Other ways to achieve this are to remove sections of the dielectric material, for example, by boring holes or turning grooves on the surface and/or preparing it with one or more uniform or uneven layers of dielectric or artifical dielectric (not shown).

All the horn antennas that are illustrated in FIGS. 1–3 can be made very light by choosing a dielectric material with a low refractive index. The antenna in FIG. 4 can have a wall thickness of between ¼ and ½ a wavelength in the dielectric material, which allows an especially light construction. These antennas will thus be especially useful on satelites.

The excitation of the desired field configuration in the horn occurs when the junction between the horn entrance (cylindrical waveguides in the examples) and the horn is shaped in a responsible way. Examples of these designs are found in the literature, and the figures illustrate some relevant designs. The incoming $TH_{11}$ mode could be transformed to a hybrid mode inside the cylindrical waveguide or near the junction between this and the horn by providing acute changes in the dimensions of the cross-sections in relation to the wavelength along the waveguide, or by placing inhomogenities in the waveguide, for example, by completing the dielectric core in a point of the horn throat (FIGS. 1–3), or by changing sharply the dimensions of the metallic waveguide (FIGS. 1, 3 and 4) compared with the wave length of the waveguide (FIGS. 1, 3 and 4).

As mentioned above, the whole horn antenna, including the cylindrical waveguide section, hybrid mode connections and the horn section, will preferably have complete axial symmetry. Yet it is also possible to let the waveguide section and the other parts have another shape, for example, polygonal or elliptical.

The metal grid 12 can either be placed in both the cylindrical section and horn section (FIGS. 1 and 4), or only in the horn section (FIGS. 2 and 3) and along the whole or part of it. The metal grid can have a varying structure along the horn wall, which can also have a varying, yet uniform extension. The dielectric parts can be of varying degrees of thickness.

The horn antenna, in accordance with the invention, can be manufactured by a simple process. The dielectric funnels and the inner core can be turned or cast. The continuous metal surfaces together with the metallized surfaces in the metal grids can be treated by a metallizing process. The nonmetallic surfaces in the grid can be made either by hindering the metal from attaching on these areas, or by removing the metal that is applied. For this purpose photolithography or etching can be used. In this way the mechanical lathe operations can be avoided, and, yet, narrower tolerances in the millimeter-wave area can be acheived where the antenna dimensions are small.

We claim:

1. An antenna for radiating or receiving polarized electro-magnetic waves including a linear portion and an expanding horn-shaped portion, the expanding horn-shaped portion including a wall having at least one grid of electrically conductive material spaced along the horn wall, and a dielectric material having an outer surface situated on the inside of the grid for creating an anisotropically reacting wall, and wherein the at least one grid comprises discontinuous metalized deposits disposed on portions of the outer surface of the dielectric material.

2. The antenna of claim 1, wherein the metalized deposits comprise a plurality of circumferentially extending, evenly spaced rings along the horn wall.

3. The antenna of claim 2, wherein each circumferentially extending ring includes non-uniform widths of metalized deposits around the horn wall.

4. The antenna of claim 2, wherein each circumferentially extending ring comprises an undulating pattern around the horn wall.

5. The antenna of claim 1, wherein the metalized deposits comprise a plurality of equally spaced rows along the horn wall.

6. An antenna for radiating or receiving polarized electro-magnetic waves including a linear portion and a expanding horn-shaped portion, the expanding horn-shaped portion including an inner wall having at least one grid of electrically conductive material spaced along the inner wall, an outer wall having a continuous, electrically conductive coating, and a dielectric material situated between the inner wall and the outer wall for creating an anisotropically reacting wall, and wherein the at least one grid comprises discontinuous metalized deposits disposed on portions of the inner wall.

7. The antenna of claim 6, wherein the metalized deposits comprise a plurality of equally spaced rings around the inner horn wall.

8. The antenna of claim 7, wherein each ring includes non-uniform widths of metalized deposits disposed on the inner wall.

9. The antenna of claim 7, wherein each ring includes metalized deposits disposed in an undulating pattern on the inner wall.

10. The antenna of claim 6, wherein the metalized deposits comprise a plurality of equally spaced rows along the inner wall.

* * * * *